United States Patent [19]

Moritz et al.

[11] 4,089,113

[45] May 16, 1978

[54] THREAD SNIP

[75] Inventors: Lyle E. Moritz; John L. Fortuin, both of Springville, N.Y.

[73] Assignee: Robinson Knife Manufacturing Co., Inc., Springville, N.Y.

[21] Appl. No.: 822,395

[22] Filed: Aug. 8, 1977

[51] Int. Cl.[2] ..... B26B 13/04

[52] U.S. Cl. ..... 30/253

[58] Field of Search ..... 30/253, 254, 260, 261

[56] References Cited

U.S. PATENT DOCUMENTS

| | | | |
|---|---|---|---|
| 415,216 | 11/1889 | McDonough | 30/253 |
| 1,186,235 | 6/1916 | Schrade | 30/261 X |
| 2,142,738 | 1/1939 | Wakeley | 30/253 |
| 2,505,705 | 4/1950 | Cohn | 30/253 |
| 3,453,651 | 7/1969 | Wertepny | 30/253 |

FOREIGN PATENT DOCUMENTS

| | | | |
|---|---|---|---|
| 930,151 | 7/1973 | Canada | 30/253 X |

*Primary Examiner*—Jimmy C. Peters
*Attorney, Agent, or Firm*—Bean, Kauffman & Bean

[57] ABSTRACT

A thread snip comprising a pair of handle members formed of a resiliently deformable material and defining interlocking flange portions cooperating to support the handle members for swinging movements between open and closed positions and mounting a pair of bent metal cutting blades for operative cutting engagement incident to movement of the handle members towards closed position.

11 Claims, 8 Drawing Figures

8
18c
18
18b
24b
23
10
20c
20
20b
6
5
36
38
24
12
30
26
22
16
14
32
24a
32c
32d
26a
26b
28
7
4
32b
40b
40
34
30b
30

Fig. 5.
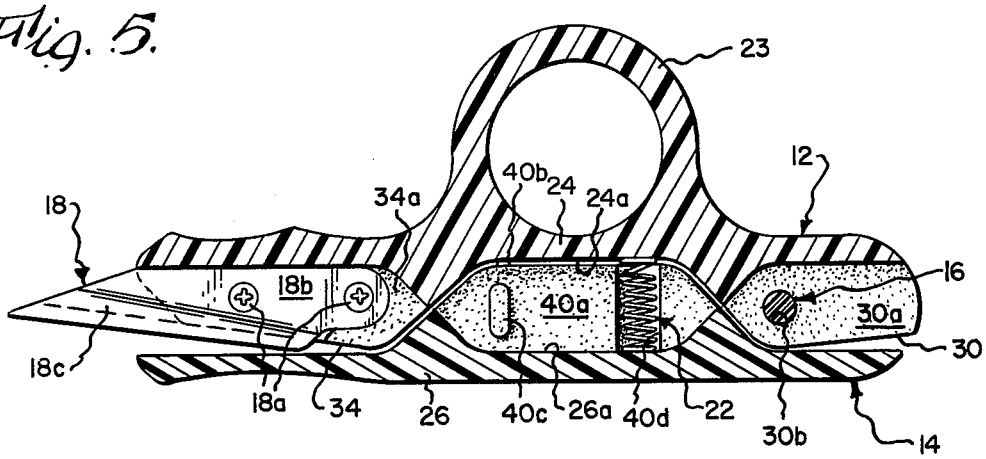
Fig. 6.
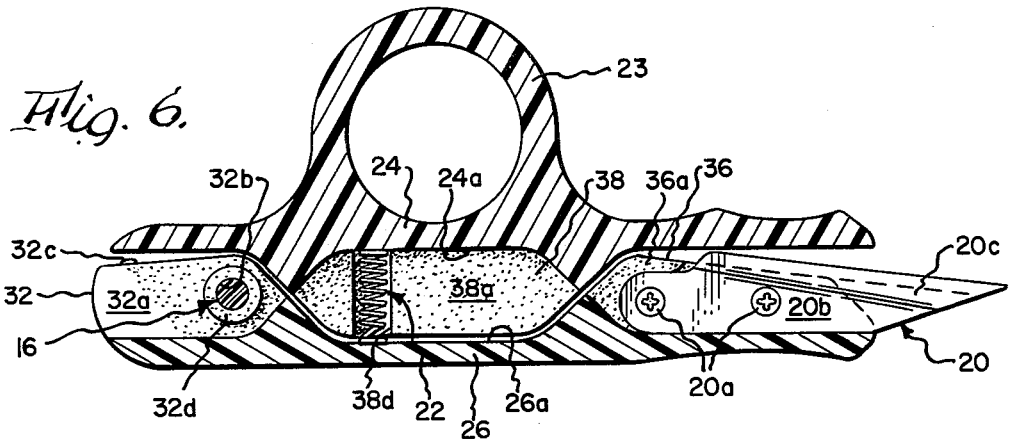
Fig. 7.
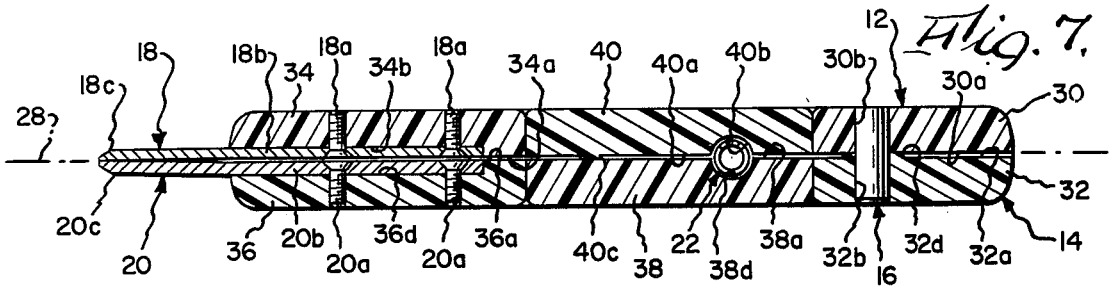
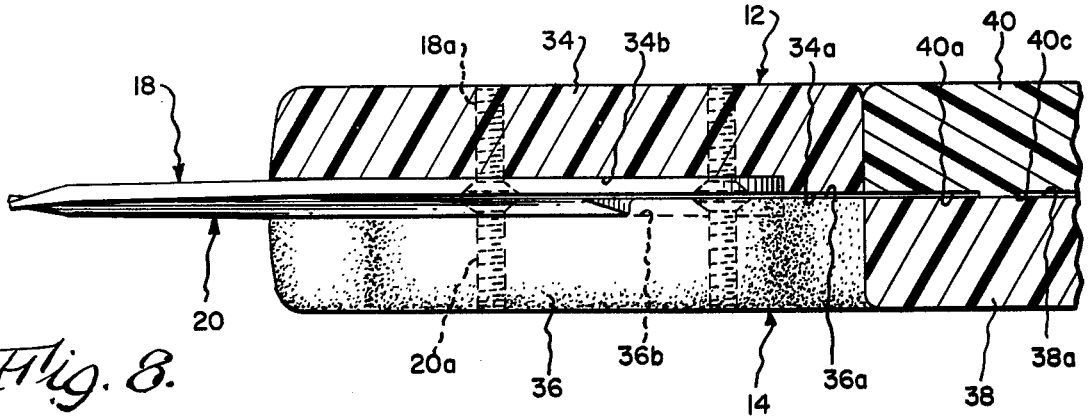
Fig. 8.

THREAD SNIP

BACKGROUND OF THE INVENTION

The present invention relates to cutting tools and more particularly to improvements in thread snips or scissors of the type generally characterized as including a pair of handle members, which are hingedly joined adjacent their rear ends and carry cutting blades adjacent their front ends, such that the blades are disposed in operative cutting engagement when the handle members are swung towards one another by the fingers of an operator. In a scissors construction of the type under consideration, spring means are normally provided to bias the handle members for movement into their open positions and separate means employed to maintain the cutting blades in operative engagement as the handle members are swung towards their closed positions.

SUMMARY OF THE INVENTION

The present invention is directed towards an improved thread snip construction and more particularly the present invention contemplates a construction wherein separately formed, hinge pin connected plastic handle members cooperate to resiliently maintain a pair of separately formed bent metal blades in engagement for performing a cutting operation and to define the open and closed positions of the thread snips.

In a preferred construction, each of the handle members includes an elongated main body portion, which is lengthwise bisected by a plane arranged normal to the axis of the hinge pin, and formed integrally with a rearwardly disposed flange portion for mounting one end of the hinge pin, a forwardly disposed flange portion for mounting one of the cutting blades and a flange portion arranged intermediate and on a side of the plane opposite to the cutting blade and hinge pin mounting flange portions. The flange portions of the handle members project from facing surfaces of their associated main body portions with like ones of the flange portions being arranged in an overlapping facing relationship and cooperating to constrain separating movements of the handle members in opposite directions aligned with the axis of the hinge pin. Resilient means preferably in the form of a coil type compression spring is housed within a cavity bounded by the intermediate flange portions for opposite end bearing engagement with the main body portions for the purpose of normally maintaining the handle members in open position.

DRAWINGS

The nature and mode of operation of the present invention is more clearly described in the following detailed description taken with the accompanying drawings wherein:

FIG. 5 is a sectional view taken generally along line 5—5 in FIG. 4;

FIG. 6 is a sectional view taken generally along line 6—6 in FIG. 4;

FIG. 7 is a sectional view taken generally along line 7—7 in FIG. 2; and FIG. 8 is a sectional view taken generally along line 8—8 in FIG. 1.

DETAILED DESCRIPTION

Figures 1, 2, 3, 4:
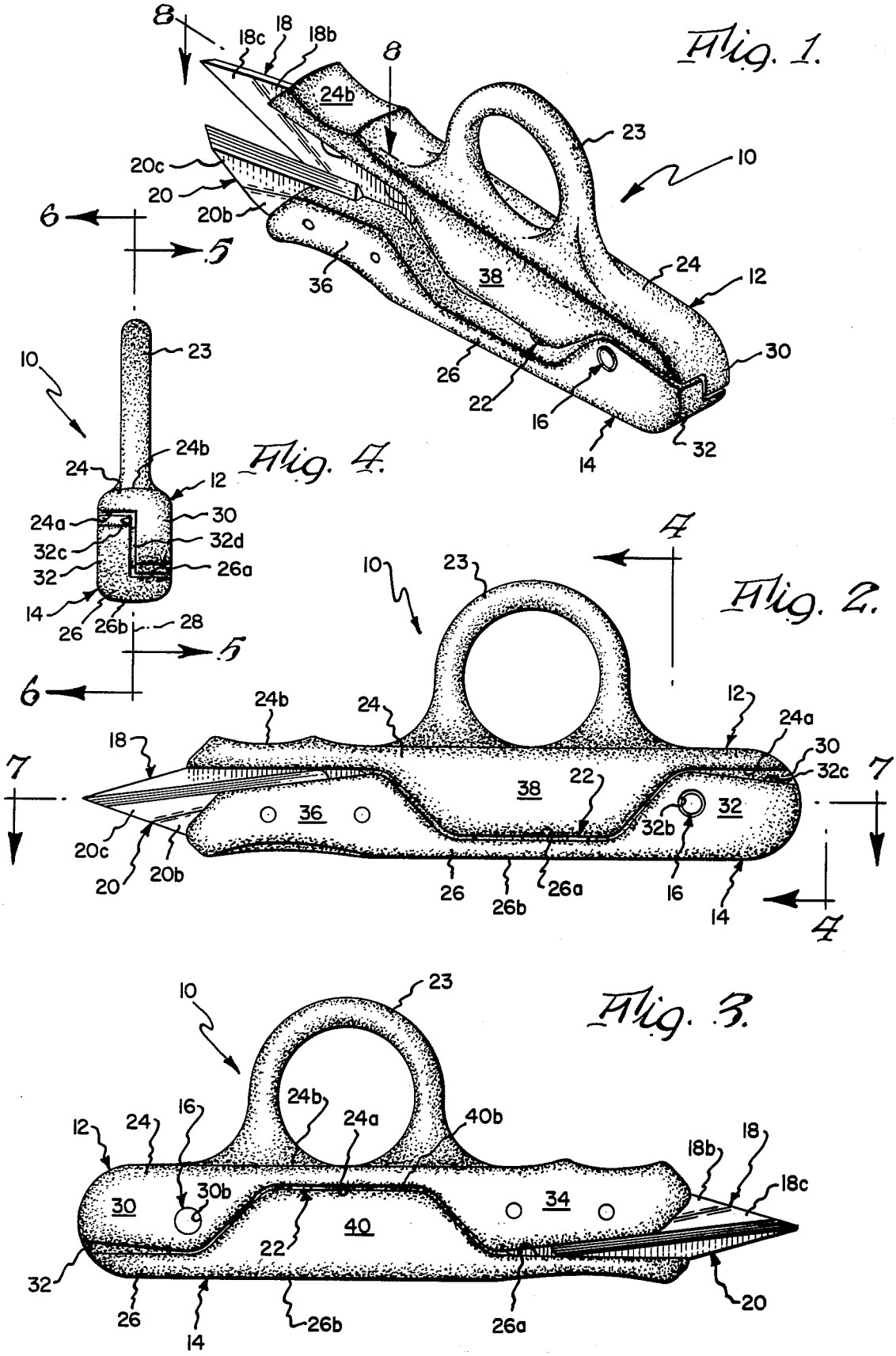
FIG. 1 is a perspective view of the thread snip formed in accordance with the present invention.
FIG. 2 is a side elevational view thereof.
FIG. 3 is an opposite side elevational view thereof.
FIG. 4 is an end elevational view thereof.

Reference is first made to FIGS. 1–5, wherein a manually operable cutting device in the form of a "thread snip" formed in accordance with the present invention is designated as 10, Device 10 generally includes a pair of operator manipulated handle members 12 and 14, which are mold formed from a resiliently deformable plastic material; a hinge pin 16 for hingedly connecting rear ends of handle members 12 and 14 to permit swinging movements thereof between open and closed positions shown for instance in FIGS. 1 and 2, respectively; a pair of metal cutting blades 18 and 20 mounted on forward ends of handle members 12 and 14, respectively; and resiliently deformable means, such as a coil type compression spring 22, which normally tends to bias handle members 12 and 14 for movement into open position. One or the other of handle members 12 and 14 would normally be formed with a conventional finger loop 23.

Handle members 12 and 14 are of similar construction from the standpoint that they include elongated main body portions 24 and 26, which together with their facing surfaces **24*a* and 26*a* are lengthwise bisected by a plane designated as 28 in FIGS. 4 and 7. Main body portions 24 and 26 are formed integrally with hinge pin mounting or rear flange portions 30 and 32, cutting blade mounting or front flange portions 34 and 36, and intermediate flange portions 38 and 40, respectively, wherein intermediate flange portions 38 and 40 are arranged intermediate their associated hinge pin and cutting blade mounting flange portions in a direction extending lengthwise of their associated main body portions and are disposed on a side of plane 28 opposite to their associated flange portions. As will be apparent from viewing FIGS. 1–8, associated flange portions 30, 34 and 38 and 32, 36 and 40 project from facing surfaces 24*a* and 26*a***, respectively, with like ones of such flnage portions having their respective inner surfaces, which are designated by suffix "*a*" arranged in an overlapping facing relationship.

Hinge pin mounting flange portions 30 and 32 are formed with aligned openings **30*b* and 32*b* sized to receive opposite ends of hinge pin 16, whereby to connect handle members 12 and 14 for swinging movement between open and closed positions. The open position of the handle members may be suitably defined, as by engagement of one or both of flange portions 30 and 32 with facing surfaces 26*a* and 24*a*, respectively. However, it is preferable to define such open position by providing flange portion 32 with a small stop or projection 32*c* arranged to engage with surface 24*a*. Also, it is preferable to limit the extent of bearing engagement between inner surfaces 30*a* and 32*a* by providing flange portion 32 with an annular enlargement 32*d*, which is disposed concentrically of hinge pin receiving opening 32*b* for rotary sliding engagement with surface 30*a***.

As best shown in FIGS. 7 and 8, cutting blade mounting flange portions 34 and 36 having their facing inner surfaces **34*a* and 36*a* recessed to define substantially parallel mounting surfaces 34*b* and 36*b* against which cutting blades 18 and 20 may be clampingly secured, as by screw devices 18*a* and 20*a*, respectively. It will be noted that cutting blades 18 and 20 are bent to define mounting end portions 18*b* and 20*b*, which are clamped in engagement with mounting surfaces 34*b* and 36*b*, such that they are disposed in an essentially parallel relationship; and cutting end portions 18*c* and 20*c*, which converge in a direction extending forwardly of handle members 12 and 14, i.e. to the left as viewed in FIG. 8. Thus, when handle members 12 and 14 are swung from an open position, as viewed in FIG. 8 towards closed position, as viewed in FIG. 7, the cutting edges defined by cutting end portions 18***c* and 20*c* engage at points moving progressively in the direction of convergence.

The closed position of handle members 12 and 14 may be suitably defined, as by engagement of one or both of intermediate flange portions 38 and 40 with facing surfaces 26*a* and 24*a*, respectively. However, it is preferable to define such closed position by providing flange portion 40 with a small stop of projection 40*b* arranged to underengage with surface 24*a*, as best shown in FIGS. 3 and 5. It is also preferable to limit the extent of bearing engagement between inner surfaces 38*a* and 40*a* by providing flange portion 40 with an elongated enlargement or intermediate bearing rib 40*c* arranged for sliding engagement with inner surface 38*a*.

By now referring to FIGS. 5–7, it will be seen that inner surfaces 38*a* and 40*a* of the intermediate flange portions are formed with aligned recesses 38*d* and 40*d*, which are sized to loosely receive coil spring 22, such that when handle members 12 and 14 are assembled in the manner to be described, spring 22 is retained or captured in its operative position best shown in FIGS. 5, 6 and 7, with its opposite ends arranged in bearing engagement with facing surfaces 24*a* and 26*a*.

By viewing FIGS. 1, 2 and 7, it will be understood that the outwardly facing surfaces 24*b* and 26*b* of main body portions 24 and 26 are coextensive in width and of substantial surface area in order to premit an operator to more comfortably apply fingers/thumb operating pressure to the thread snip. It will also be appreciated that the forward ends of main body portions 24 and 26 additionally serve to shield the fingers/thumb of an operator from engagement with cutting blades 18 and 20, during normal use of the thread snip.

In assembling device 10, cutting blades 18 and 20 would first be mounted on flange portions 34 and 36. Then after placing the spring in one or the other or simultaneously in both of recesses 38*d* and 40*d*, handle members 12 and 14 would be moved towards one another to inter-fit their flange portions and arrange the inner surfaces of like ones of such flange portion in a face to face overlapping relationship. Hinge pin 16 would then be fully inserted through openings 30*b* and 32*b* to retain device 10 in assembled condition. As a practical matter, inwardly bent cutting end portions 18*c* and 20*c* prevent inter-fitting of the flange portions by the rectilinear assembling movement of handle members, i.e. movement of the inner surfaces of the flange portions parallel to plane 28. Thus, after placement of opposite end portions of spring 22 within recesses 38*d* and 40*d*, it is necessary to slightly tilt the front ends of handle members 12 and 14 towards one another, while slightly cocking the handle members, i.e. effecting relative pivotal movements thereof generally about the axis of spring 22, sufficiently to move the cutting end portions 18*c* and 20*c* past one another. Thereafter, the rear ends of handle members 12 and 14 are brought together sufficiently to align openings 30*b* and 32*b* and pin 16 inserted. Alternatively, assembly of device 10 may be effected by placing opposite end portions of spring 22 within recesses 38*d* and 40*d*, and then exerting finger pressure on handle members 12 and 14 in a direction extending transversely thereof in order to bend body portions 24 and 26 sufficiently to permit cutting end portions 18*c* and 20*c* to move past one another, as the handle members are moved towards one another. Assembly is completed, as before, by the insertion of hinge pin 16. Of course, the thread snip may be machine assembled, if desired.

Thus, a feature of the thread snip of the present invention is its simplicity of construction and the ease with which it may be assembled. Another feature of the present invention is that the flange portions cooperate to prevent separating movements of the assembled handle members in opposite directions aligned with the axis of hinge pin 22. This negates the need for bonding or providing mechanical fastening devices to attach hinge pin 22 to both of flange portions 30 and 32, and greatly facilitates removal of the hinge pin for disassembling purposes, when cutting blades 18 and 20 require resharpening. Also, an important feature of the construction of handle members 12 and 14 is that flange portions 30 and 32 are retained in an essentially parallel relationship by cooperative bearing engagement of inner surfaces 30*a*, 32*a* and inner surface 38*a*, 40*a* in order to prevent binding of hinge pin 16 within openings 30*b* and 32*b*, while the forward ends of body portions 24 and 26 are permitted to resiliently deform in order to permit flange portions 34 and 36 to spring apart as the point of contact between cutting end portions 18*c* and 20*c* moves in the direction of convergence incident to movement of handle members towards their closed positions. The bias established by deformation of the body portions in this manner, serves to properly retain the cutting end portions in operative cutting engagement.

We claim:

1. A manually operable cutting device including in combination:

a pair of elongated, operator manipulated handle members formed of a resiliently deformable material and having front and rear ends;

a hinge means for coupling said rear ends of said handle members to permit pivotal movements of said handle members about an axis, said handle members having integrally formed bearing surfaces disposed essentially normal to said axis and arranged in engagement for preventing disassembling movement of said handle members in opposite directions aligned with said axis and integrally formed stop means engageable for limiting said pivotal movements to define open and closed positions of said handle members;

a pair of cutting blades bent intermediate their ends to define mounting and cutting blade end portions arranged at an angle one portion to another, said cutting blades having said mounting end portion thereof fixed one to each of facing surfaces of said front ends of said handle members for arranging said cutting blade end portions thereof to converge in a direction extending from said rear ends towards said front ends of said handle members, whereby said cutting blade end portions engage at points moving progressively in the direction of convergence as said handle members pivot towards said closed position; and resiliently deformable means tending to bias said handle members for movement into said open position.

2. A cutting device according to claim 1, wherein a first of said stop means is arranged adjacent said rear ends of said handle members and defines said open position, and a second of said stop means is arranged intermediate said front and rear ends and defines said closed position.

3. A cutting device according to claim 1, wherein said resiliently deformable means is a coil type compression spring device arranged for opposite end bearing engagement with said handle members intermediate said front and rear ends thereof.

4. A cutting device according to claim 1, wherein said hinge means is a hinge pin, said handle members include operator manipulated main body portions and flange portions depending from facing surfaces of said main body portions and arranged in an overlapping/interlocking relationship, and said flange portions defining said bearing surfaces and mounting said cutting blades and said hinge pin.

5. A cutting device according to claim 1, wherein said handle members each include an elongated main body portion, a flange portion for mounting said hinge means, a flange portion for mounting one of said cutting blades and a flange portion arranged intermediate said cutting blade and hinge means mounting flange portions, said flange portions of said handle members projecting from facing surfaces of their associated main body portions with like ones of said flange portions being arranged in an overlapping relationship and with the intermediate flange portions being offset relative to said hinge means and cutting blade mounting flanges of their associated handle members to interlock said handle members for preventing said disassembling movement.

6. A cutting device according to claim 5, wherein facing surfaces of said intermediate flange portions are formed with openings cooperating to positionally receive said resiliently deformable means with opposite ends thereof arranged in bearing engagement with said main body portions of said handle members.

7. A cutting device according to claim 6, wherein said hinge means is a hinge pin opposite end received within aligned openings formed in said hinge means mounting flange portions, a first of said stop means is defined by abutting surfaces of said hinge means mounting flange portion of one of said handle members and said facing surface of said main body portion of the other of said handle members and determines said open position; and a second of said stop means is defined by abutting surfaces of said intermediate flange portion of one of said handle members and said facing surface of said main body portion of the other of said handle members and determines said closed position.

8. In a cutting device having a pair of manually manipulatable handle members carrying cutting blades adjacent front ends thereof and being hinge pin connected adjacent rear ends thereof for swinging movement essentially within a plane disposed normal to the axis of said hinge pin between open and closed positions for effecting cooperative cutting engagement of said cutting blades, and resilient means tending to bias said handle members towards said open position, the improvement comprising in combination:

said handle members are formed of resiliently deformable plastic material and each of said handle members includes an elongated main body portion lengthwise bisected by said plane and formed integrally with a flange portion for mounting one end of said hinge pin, a flange portion for mounting one of said cutting blades and a flange portion arranged intermediate and on a side of said plane opposite to said cutting blade and hinge pin mounting flange portions, said flange portions of said handle members projecting from facing surfaces of their associated main body portions with like ones of said flange portions being arranged in an overlapping facing relationship and cooperating to constrain separating movements of said handle members in opposite directions aligned with said axis, and said resilient means is housed within aligned recesses defined by the intermediate flange portions.

9. The improvement according to claim 8, wherein said resilient means is a coil spring.

10. A manually operable cutting device comprising in combination:

a hinge pin;

a pair of operator manipulatable handle members mold formed of resiliently deformable plastic material, each of said handle members including an elongated main body portion formed internally with front, rear and intermediate flange portions depending from one surface thereof with said intermediate flange portion being disposed on a side of a plane lengthwise bisecting said one surface opposite to said front and rear flange portions, whereby inner surfaces of said flange portions face said plane, said handle members having said flange portions thereof arranged in an overlapping relationship with inner surfaces of like ones of said flange portions arranged in a facing relationship, said handle members having their associated rear flange portions formed with aligned openings passing through said inner surfaces thereof to receive opposite ends of said hinge pin fo joining said handle members for swinging movements between open and closed positions within a plane disposed essentially coincident with the planes bisecting the surface of said main body portions and arranged in a right angular relationship relative to an axis of said hinge pin;

a pair of metal cutting blades each bent intermediate its ends to define mounting and cutting blade portions, said mounting blade portions being fixed to said inner surfaces of said mounting flange portions to assume an essentially parallel relationship and to position said cutting blade portions to converge in a direction extending forwardly of said handle members for effecting operative cutting engagement thereof as said handle members are swung between said open and closed positions; and a coil type compression spring for biasing said handle members for movement into said open position, said spring being disposed within a cavity bounded by aligned recesses formed in said inner surfaces of the intermediate flange portions for opposite end bearing engagement with said surfaces of the main body portions of said handle members.

11. A cutting device according to claim 10, wherein said closed position is defined by engagement of at least one of said intermediate flange portions of one of said handle members with said one surface of the main body portion of the other of said handle members, said open position is defined by engagement of at least one of said rear flange portions of one of said handle members with said one surface of the main body portion of the other of said handle members, said inner surface of one of the rear flange portions being formed with an annular projection bounding said opening thereof, said projection defining a rear bearing surface arranged in surface-to-surface bearing engagement with said inner surface of the other of said rear flange portions, said inner surface of one of said intermediate flange portions being formed with a projection defining an intermediate bearing surface arranged in surface-to-surface bearing engagement with said inner surface of the other of said intermediate flange portions.

* * * * *